United States Patent [19]

Brown

[11] 4,020,523

[45] May 3, 1977

[54] PAINT BRUSH DIP GAUGE

[76] Inventor: Theodore G. Brown, 4401 Lantana Ave., Sacramento, Calif. 95824

[22] Filed: Apr. 14, 1976

[21] Appl. No.: 676,907

[52] U.S. Cl. ..... 15/257.05; 220/90

[51] Int. Cl.[2] ..... A47L 13/56

[58] Field of Search ..... 15/257.05, 257.06; 220/90

[56] References Cited

UNITED STATES PATENTS

| | | | |
|---|---|---|---|
| 2,369,335 | 2/1945 | Burman | 15/257.05 |
| 2,756,899 | 7/1956 | Crandall | 22/90 |
| 2,939,162 | 6/1960 | Kravitt | 15/257.05 |
| 3,191,799 | 6/1965 | Figge | 220/90 |
| 3,436,784 | 4/1969 | Moore | 15/257.05 |

*Primary Examiner*—Edward T. McCarthy
*Attorney, Agent, or Firm*—John N. Randolph

[57] ABSTRACT

A plate of porous or open work construction detachably mounted in a paint receptacle and buoyantly supported at a predetermined depth beneath the surface of the paint to be engaged by the tips of the bristles of a paint brush, to prevent the paint brush from being dipped too deep into the paint and to indicate when the paint brush has been dipped to a desired depth.

6 Claims, 4 Drawing Figures

PAINT BRUSH DIP GAUGE

SUMMARY

It is a primary object of the present invention to provide a removable dip gauge for a paint receptacle having a surface to be engaged by the bristle tips of a paint brush and which will always be disposed at a desired depth beneath the surface of the paint.

More particularly, it is an object of the invention to provide a basket-like member consisting of a porous or mesh bottom and a surrounding upstanding hollow wall constituting a buoyant means for supporting said bottom at a predetermined depth relative to the surface of the paint in a receptacle.

Another object of the invention is to provide such a depth gauge which may additionally include a ring supported by said hollow wall and thereabove, across which the paint brush bristles can be drawn for wiping excess paint therefrom after the brush has been dipped.

Various other objects and advantages of the invention will hereinafter become more fully apparent from the following description of the drawing, illustrating a presently preferred embodiment thereof, and wherein:

DESCRIPTION OF THE PREFERRED EMBODIMENT

Figure 1:
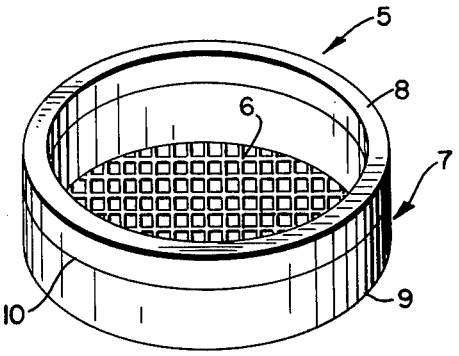
FIG. 1 is a perspective view of a preferred embodiment of the dip gauge.
Figure 2:
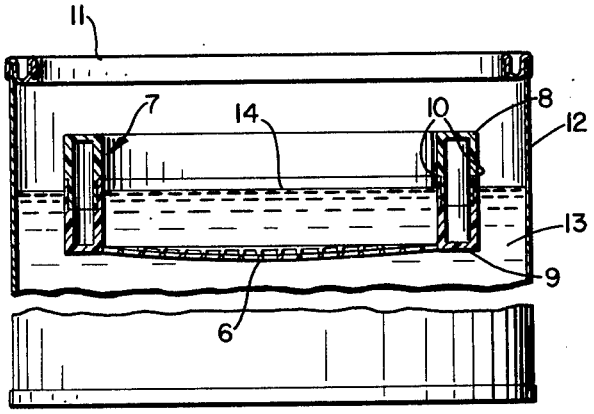
FIG. 2 is a sectional view taken substantially diametrically through the dip gauge and through a paint containing receptacle in which the dip gauge is removably and buoyantly contained.
Figure 3:
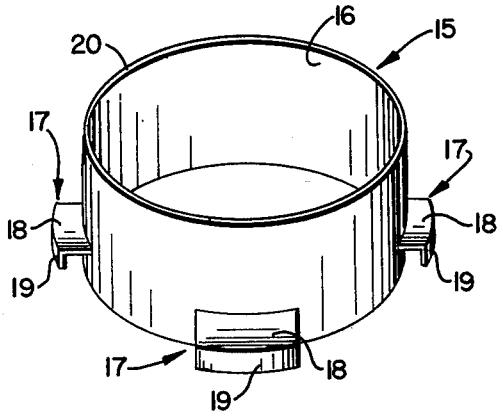
FIG. 3 is a perspective view of a brush wiping attachment for the dip gauge.

Referring more specifically to the drawing, the dip gauge as shown in FIG. 1 is designated generally 5 and comprises a porous plate or disc 6, preferably formed of a coarse mesh, and a surrounding upstanding tubular wall 7 which is attached to and rises from the periphery or margin of the bottom 6. The wall 7, which has an outer diameter or width greater than the maximum diameter or width of the bottom 6, is of rectangular cross section and of a vertical dimension substantially greater than its horizontal dimension, as seen in FIGS. 1, 2 and 3. The wall 7 may be composed of interfitting top and bottom sections 8 and 9, the inner and outer walls of which interfit to provide a joint 10.

The diameter or maximum width of the dip gauge 5 is less than the diameter of minimum width of the opening 11 in the top of a paint receptacle 12. The dip gauge 5 is applied to the receptacle 12 through the open top 11 thereof and is buoyantly supported by the wall 7 in the paint 13 contained in the receptacle 12, so that the plate or bottom 6 will be disposed at a desired depth beneath the surface 14 of the paint 13, preferably between one-quarter and one-half of an inch.

With the dip gauge 5 disposed in the receptacle 12, as illustrated in FIG. 2, it will be readily apparent that when a paint brush, not shown, is inserted into the receptacle 12 through its open top 11, the outer edge of the bristle mass of the brush head after being submerged into the paint 13 will contact the gauge surface 6 and will be obstructed thereby from being further submerged in the paint 13, so that the brush will only be dipped to a desired extent. Since the bristle mass is usually quite flexible, it will yield when contacting the gauge surface 6 rather than exerting sufficient force against said surface to further submerge the gauge 5, especially since very little downward pressure is normally applied to the brush when dipping it into the paint. As best illustrated in FIG. 2, the gauge surface or bottom 6 is preferably bowed downwardly to provide a concave upper side so that only the bristle tips at the two side edges of the bristle mass will contact the surface 6. Thus, the minimum amount of pressure will be exerted by the bristle mass on the gauge 5.

Figure 4:
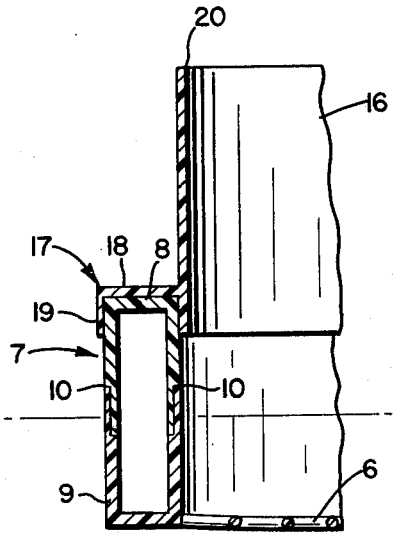
FIG. 4 is an enlarged fragmentary radial sectional view taken through a part of the dip gauge and showing a part of the attachment of FIG. 3 applied thereto.

FIG. 3 illustrates a brush wiping attachment 15 which may or may not be used with the gauge 5 and which includes a cylinder 16 having a diameter such that the bottom portion thereof will fit snugly and detachably in the upper portion of the wall 7. Two or more lugs 17, which are preferably formed integral with the cylinder 16, each includes a portion 18 which extends outwardly from the cylinder 16 and which rests upon a part of the top surface of the wall 7, and a depending arcuately bowed outer flange 19 which conformably engages a part of the outer surface of the wall 7, for mounting the wiping attachment 15 thereon, as illustrated in FIG. 4. The upper edge 20 of the cylinder 16 constitutes a wiping ring across which one or both sides of the bristle mass of the paint brush can be drawn, after dipping, for wiping excess paint from the bristles.

The dip gauge 5 and the wiping attachment 15 may both be formed entirely of plastic or of any other suitable material. Obviously, the gauge 5 and attachment 15 may be made in various sizes depending upon the size of the container 12 with which said parts are to be utilized, and various other modifications and changes are contemplated and may be resorted to without departing from the function or scope of the invention.

I claim as my invention:

1. A paint brush dip gauge comprising a porous plate, a buoyant member attached to and rising from the margin of said plate for supporting the plate at a desired depth below the surface of a body of paint, a paint brush wiping ring, and means demountably supporting said ring on said buoyant member and at a predetermined level thereabove.

2. A paint brush dip gauge as in claim 1, said gauge being of a size to pass freely through the open top of a receptacle containing the paint.

3. A paint brush dip gauge as in claim 1, said buoyant member comprising a tubular wall.

4. A paint brush dip gauge as in claim 3, said tubular wall being of rectangular cross section and having a vertical dimension greater than a horizontal dimension thereof.

5. A paint brush dip gauge as in claim 1, said plate being of coarse mesh.

6. A paint brush dip gauge as in claim 1, said plate being dished to provide a concave upper surface.

* * * * *